United States Patent [19]

Lentz et al.

[11] Patent Number: 4,759,833

[45] Date of Patent: Jul. 26, 1988

[54] ELECTROLYTIC METHOD OF SIMULTANEOUSLY PREPARING DIARYLIODONIUM SALT AND ALKOXIDE SALT AND METHOD OF PREPARING ESTER OF AN AROMATIC ACID

[75] Inventors: Carl M. Lentz; Michael R. Cushman; James R. Overton; David D. Cornell, all of Kingsport, Tenn.

[73] Assignee: Eastman Kodak Company, Rochester, N.Y.

[21] Appl. No.: 115,303

[22] Filed: Nov. 2, 1987

[51] Int. Cl.[4] ..... C25C 1/00

[52] U.S. Cl. ..... 204/59 R

[58] Field of Search ..... 204/59 R, 78

[56] References Cited

U.S. PATENT DOCUMENTS

| | | | |
|---|---|---|---|
| 3,975,439 | 8/1976 | Klabunde | 204/72 |
| 4,024,032 | 5/1977 | Weinberg | 204/59 R |
| 4,564,701 | 1/1980 | Lentz et al. | 562/406 |
| 4,594,445 | 6/1981 | Lentz et al. | 560/103 |

FOREIGN PATENT DOCUMENTS

| | | |
|---|---|---|
| 2100381Q | 1/1971 | Fed. Rep. of Germany . |
| 2154348Q | 11/1971 | Fed. Rep. of Germany . |

OTHER PUBLICATIONS

Beringer et al., J. Amer. Chem. Soc. 75:2705 (1953).
Nippon Kagaku Kaishi No. 2:236–241 (1982).
Davidson et al., J. Chem. Soc. (A):1616–1617 (1968).

*Primary Examiner*—R. L. Andrews
*Attorney, Agent, or Firm*—Charles R. Martin; William P. Heath, Jr.

[57] ABSTRACT

An electrolytic method for the simultaneous preparation of a diaryliodonium salt and an alkoxide salt comprises adding to the anode compartment of an electrolytic cell, comprised of an anode, a first electrolytic solution comprising an aromatic compound, an iodoaromatic compound, a solvent and a first organic salt; adding to the cathode compartment of the cell, comprised of a cathode, a second electrolytic solution comprising a hydroxyalkyl compound and a second organic salt; and applying to the anode and the cathode an electric potential, to form diaryliodonium salt in the anode compartment and an alkoxide salt in the cathode compartment.

Esters of an aromatic acid are prepared by carbonylating an admixture of the diaryliodonium salt and the alkoxide salt by the addition of carbon monoxide thereto.

18 Claims, No Drawings

ELECTROLYTIC METHOD OF SIMULTANEOUSLY PREPARING DIARYLIODONIUM SALT AND ALKOXIDE SALT AND METHOD OF PREPARING ESTER OF AN AROMATIC ACID

BACKGROUND OF THE INVENTION

1. Field of the Invention

The present invention relates to an electrolytic method for the simultaneous preparation of a diaryliodonium salt and an alkoxide salt comprising adding to the anode compartment of an electrolytic cell an aromatic compound, an iodoaromatic compound, a solvent and a first organic salt, adding to the cathode compartment a hydroxyalkyl compound and a second organic salt, and applying an electric potential to the anode and the cathode to form a diaryliodonium salt in the anode compartment and an alkoxide salt in the cathode compartment. The invention also relates to a method of producing an ester of an aromatic acid wherein a mixture of the diaryliodonium salt and alkoxide salt obtained as described above are carbonylated by the addition of carbon monoxide to form the ester.

2. Description of the Prior Art

Diaryliodonium salts have long been known and can be prepared by various methods known in the art summarized below (Beringer, et al, J. Amer. Chem. Soc. 75: 2705 (1953); ibid., 81: 342 (1959)).

(A) Coupling of two aromatic compounds with iodyl sulfate in sulfuric acid.

$$4ArH+(IO)_2SO_4+3H_2SO_4 \rightarrow 2Ar_2I^+ + 2H_3O^+ + 4\text{-}HSO_4^-$$

(B) Coupling of two aromatic compounds with an iodate in acetic acid-acetic anhydride sulfuric acid.

$$2ArH+IO_3+2H_2SO_4+2Ac_2O \rightarrow Ar_2I^+ + 2\text{-}HSO_4^- + 4AcOH + [O]$$

(C) Coupling of two aromatic compounds with an iodine (III) acylate in the presence of an acid.

$$2ArH + I(O\overset{O}{\overset{\|}{C}}R)_3 + HX \longrightarrow Ar_2I^+X^- + 3R\overset{O}{\overset{\|}{C}}OH$$

(D) Condensation of an iodoso compound, an iodoso diacetate or an iodoxy compound with another aromatic compound in the presence of an acid.

$$ArIO + Ar'H + H_2SO_4 \longrightarrow ArI^+Ar'HOSO_3^- + H_2O$$

$$ArI(OAc)_2 + Ar'H + H_2SO_4 \longrightarrow ArI^+Ar'HOSO_3^- + 2AcOH$$

$$ArI(OAc)_2 + Ar'H + F_3CCOOH \longrightarrow ArI^+Ar'F_3CCO_3^- + 2AcOH$$

$$ArIO_2 + Ar'H + H_2SO_4 \longrightarrow ArI^+Ar'HOSO_3^- + H_2O + [O]$$

In some cases it has been possible to oxidize an iodo compound in situ and then to condense it with another aromatic compound:

$$ArI \xrightarrow[H_2SO_4]{\text{oxidation}} \xrightarrow{Ar'H} ArI^+Ar'HOSO_3^-$$

Diaryliodonium salts have been utilized in the preparation of aromatic carboxylic acids and esters thereof by a variety of carbonylation processes well known in the art. One such carbonylation process reacts a diarylidonium salt with carbon monoxide and an alcohol in the presence of a palladium catalyst (e.g., Nippon Kagaku Kaishi No. 2:236–241 (1982), which is incorporated herein by reference). Another carbonylation process reacts diphenyliodonium bromide and carbon monoxide at 190 atm in methanol at 100° C. in the absence of a catalyst (Davidson, et al, J. Chem. Soc.(A): 1616–17 (1968), which is incorporated herein by reference). In yet another process, a diaryliodonium salt is reacted with carbon monoxide in the presence of zero-valent palladium in a hydrocarbon acid reaction medium (e.g., U.S. Pat. No. 4,564,701 to Lentz, et al, which is incorporated herein by reference). In yet another process, a diaryliodonium salt is reacted with carbon monoxide and water and an alcohol or amine in a basic reaction medium having a $pK_b$ greater than about 8 (e.g., U.S. Pat. No. 4,594,445 to Lentz, et al, which is incorporated herein by reference).

The aromatic acids and esters thereof are useful as intermediates in the synthesis of polyesters such as poly(ethylene terephthalate) and other useful polymeric materials.

The availability of the various aforementioned methods for the preparation of diaryliodonium salts, notwithstanding, there remains a need for an improved method and in particular a method of simultaneously producing a diaryliodonium salt and an alkoxide salt.

SUMMARY OF THE INVENTION

This invention relates to an electrolytic method for the simultaneous preparation of a diaryliodonium salt and an alkoxide salt, comprising adding to the anode compartment of an electrolytic cell comprised of an anode a first electrolytic solution comprising an aryl compound, an iodoaryl compound, a solvent and a first organic salt; adding to the cathode compartment of the cell comprised of a cathode a second electrolytic solution comprising a hydroxyalkyl compound and a second organic salt; and applying to the anode and the cathode an electric potential, said potential and the proportion of said compounds and said salts being effective to form a diaryliodonium salt in the anode compartment and an alkoxide salt in the cathode compartment.

This invention also relates to a method of preparing an alkyl ester of an aryl acid, comprising adding to the anode compartment of an electrolytic cell comprised of an anode a first electrolytic solution comprising an aryl compound, an iodoaryl compound, a solvent and a first organic salt; adding to the cathode compartment of the cell comprised of a cathode a second electrolytic solution comprising a hydroxyalkyl compound and a second organic salt; applying to the anode and the cathode an electric potential, said potential and the proportion of said compounds and said salts being effective to form a diaryliodonium salt in the anode compartment and an alkoxide salt in the cathode compartment; and admixing the diaryliodonium salt and the alkoxide salt in the presence of carbon monoxide, the salts and the carbon monoxide being present in a proportion and under conditions effective to obtain an alkyl ester of an aryl acid.

Other objects, advantages and features of the present invention will become apparent to those skilled in the art from the following discussion.

DESCRIPTION OF THE PREFERRED EMBODIMENTS

In accordance with the present invention an iodoaromatic compound is anodically oxidized and coupled with another dissimilar aromatic compound in the anode compartment of an electrochemical cell while an alkoxide salt is simultaneously generated in the cathode compartment of the electrochemical cell.

The aromatic compound employed as a starting material in the method of the present invention is a carbocyclic or heterocyclic aromatic compound having about 5 to 20 atoms in the ring(s) thereof. Suitable examples of the aryl compound are benzene, toluene, naphthalene, pyridine, thiophene, pyrrole, and the like.

The iodoaromatic compound employed as a starting material in the process of the present invention is an iodo derivative of a carbocyclic or heterocyclic aromatic compound having about 5 to 20 atoms in the ring(s) thereof. Examples of suitable iodoaryl compounds are iodotoluene, iodobenzene, iodonaphthalene, iodopyridine, iodothiophene, iodopyrrole, and the like.

The aromatic moieties of both the aromatic compound and the iodoaromatic compound may be substituted or unsubstituted. When substituted, typical substituents include the halides, alkyl groups having from 1 to 12 carbon atoms, vinyl groups, carboxylic acid groups, carboxylic ester groups, ether groups, and the like. In general, the aromatic ring moieties may contain any substituent which does not have an adverse effect on the method of the invention or the reactions it encompasses. In a preferred embodiment of the invention, the aromatic moieties of the aryl or aromatic compound and the iodoaryl or iodoaromatic compound are the same.

The organic salts employed in the electrolytic method of the present invention are preferably alkali and tetraalkylammonium salts of weak organic acids. However, stronger organic acids may also be utilized. Examples of suitable salts are the sodium, potassium, lithium and ($C_1$–$C_{12}$)tetraalkyl ammonium salts of acetic acid, trihaloacetic acid, p-toluenesulfonic acid, IH, BrH, $F_4BH$ and benzenesulfonic acid, among others. In one preferred embodiment of the electrolytic method invention, the first and the second organic salts are the same.

The method of the invention is conducted using a solvent for the iodoaromatic compound, aromatic compound and organic salt. The solvent is preferably selected from the group consisting of polar solvents, and more preferably acyclic polar solvents. Examples of solvents suitable for use with the present invention are alcohols such as methonol, halogenated hydrocarbons such as dichloromethane and chloroform, acetonitrile, and the like.

The hydroxyalkyl compound employed as a starting material in the method of the present invention may be an aliphatic alcohol having about 1 to 12 carbon atoms or an araliphatic alcohol having about 6 to 20 carbon atoms. The aliphatic or araliphatic alcohol which is employed in the present method may be monofunctional or multifunctional. Therefore, glycol and other polyols are also suitable, as are glycol esters, glycol ethers, and other such derivatives. Preferably, the hydroxyalkyl compound is an alkanol of 1 to 12 carbon atoms such as methanol, ethanol, propanol, isopropanol, butanol, secbutanol, and tertbutanol or an araliphatic hydroxyalkyl compound such as phenyl ethanol, ethylene glycol, propylene glycol, neopentyl glycol, ethylene glycol monoacetate, mixtures thereof, and the like.

The method of the present invention is conducted using a compartmentalized electrochemical cell containing an anode compartment provided with an anode and a cathode compartment provided with a cathode. The electrolytic cell apparatus need not have the two compartments harboring the anode and the cathode separated by physical means. However, if so desired, an apparatus where such separation exists may also be utilized within the context of this invention. Examples of suitable separation means for the two compartments are membranes which may be formed of any of a variety of polymeric materials known in the art. Other separation means, however, are also suitable.

In accordance with the method of the invention the aromatic compound, iodoaromatic compound, organic salt and solvent are charged into the anode compartment and the hydroxy aromatic compound and organic salt are charged to the cathode compartment.

An electric potential preferably about 1.75 volts to 2.25 volts, more preferably 1.85 volts to 2.15 volts is then applied to the anode and cathode. The electric potential is normally applied to the anode and the cathode for a period of time of about 2 hours to 10 hours, and preferably about 5 hours to 7 hours. The reactions occurring in the anode and the cathode compartments can be conducted at temperatures of about 25° to 80° C., and preferably about 35° to 70° C., and pressures of about 1 atm to 10 atm, and preferably about 1 atm to 5 atm. In a particularaly simple embodiment of the invention, the electric potential is applied to the anode and the cathode as a constant electric potential.

The starting materials added to the anode compartment when conducting the electrolytic method of the invention can be present in a proportion of the iodoaromatic compound to the aromatic compound to the first organic salt to the solvent of about 0.8:1:1:1 to 1.2:1:10:10 by weight, and preferably about 1:1:1:1 to 1:1:10:10 by weight. The hydroxyalkyl compound and the second organic salt can be added to the cathode compartment in a proportion of about 1:1 to 1:10, and preferably 1:1 to 1:5.

In another aspect, the present invention provides a method of preparing an ester of an aromatic acid comprising the steps encompassed by the electrolytic method described above, and a subsequent carbonylation of the thus obtained diaryliodonium salt to produce the ester of an aromatic acid. The carbonylation may be conducted by admixing the diaryliodonium salt and the alkoxide salt in the presence of carbon monoxide. The carbonylation step may also be conducted in accordance with a variety of other methods known in the art, several of which have been referred to above.

In one particularly useful embodiment of the method of the invention for preparing an ester of an aromatic acid, the diaryliodonium salt, the alkoxide salt and the carbon monoxide are mixed in the further presence of a Group VIII metal catalyst such as palladium. If necessary or desirable, the solvent may be removed from the solution containing the diaryliodonium salt prior to mixing the latter with the alkoxide salt and carbon monoxide.

The diaryliodonium salt and the alkoxide salt can be mixed in the presence of carbon monoxide at temperatures of about 5° to 150° C., preferably about 10° to 120° C., and pressures of about 1 atm to 10 atm, preferably about 1 atm to 5 atm, for a period of time of about 30 minutes to 24 hours, preferably about 1 hour to 15 hours. The diaryliodonium salt and the alkoxide salt can be admixed in the presence of carbon monoxide in a proportion of about 1:1:5 to 1:2:10 by weight, preferably 1:1:5 to 1:1.5:8 by weight.

Inert solvents may be employed for the carbonylation reaction if desired. Such solvents include, for example, tetrahydrofuran, acetonitrile, and the like.

A by-product of the above-described carbonylation reaction is an iodoaromatic compound or aryl iodide. This compound can be removed from the reaction system, e.g., by distillation, and then employed as a starting material in the preparation of the diaryliodonium salt by the electrolytic method of the invention.

The present invention provides an efficient, novel and economical electrolytic method for the simultaneous preparation of a diaryliodonium salt and an alkoxide salt, themselves useful as intermediates for preparing alkyl esters of aromatic acids. These acids, in turn, are useful in the synthesis of polyesters such as poly(ethylene terephthalate), and other useful polymeric materials.

The invention will now be further illustrated by the following examples although it will be understood that these examples are included merely for purposes of illustration and are not intended to limit the scope of the invention.

EXAMPLES

EXAMPLE 1

Preparation of Diaryliodonium Salt and Alkoxide Salt

To the anode compartment of a divided electrochemical laboratory cell fitted with a platinum anode and a carbon cathode are added 50 mL of acetonitrile, 4.1 g tetrabutylammonium tetrafluoroborate, 1.5 g iodotoluene, and 1.98 g toluene (anolyte solution). To the cathode compartment are added 30 mL methanol and 2.05 g tetrabutylammonium tetrafluoroborate. A potential of 2.1 V (vs. Ag/AgCl reference electrode) is applied which results in a current of 35 milliamps at 25° to 30° C. The electrolysis is terminated after passing 257 coulombs.

The anode reaction mixture is analyzed by liquid chromatography and is shown to contain 8.7% p,p-ditolyliodonium salt, 0.87 o,p-ditolyliodonium salt, and 77.9% p-iodotoluene. The current efficiency to iodonium salt is 35%.

EXAMPLE 2

Preparation of Alkyl Ester of Aryl Acid

The solvent in the anolyte solution obtained in Example 1 above is removed under vacuum and the catholyte solution is added to the remaining anodic components. The iodonium salt is then carbonylated by addition of carbon monoxide in a diaryliodonium salt/alkoxide salt/CO ratio of 1:1:5 at a temperature of 60° C. and a pressure of 3 atm for 10 hours.

The invention has now been described in detail with particular reference to preferred embodiments thereof, but it will be understood that variations and modifications can be effected within the spirit and scope of the invention.

What is claimed is:

1. An electrolytic method for the simultaneous preparation of a diaryliodonium salt and an alkoxide salt, comprising adding to the anode compartment of an electrolytic cell comprised of an anode, a first electrolytic solution comprising an aryl compound, an iodoaryl compound, a solvent and a first organic salt; adding to the cathode compartment of the cell comprised of a cathode a second electrolytic solution comprising a hydroxyalkyl compound and a second organic salt; and applying to the anode and the cathode an electric potential, said potential and the proportion of said compounds and said salts being effective to form a diaryliodonium salt in the anode compartment and an alkoxide salt in the cathode compartment.

2. The method of claim 1, wherein the electric potential applied is about 1.75 volts to 2.25 volts.

3. The method of claim 1, wherein the electric potential is applied for a period of time of about 2 hours to 10 hours, at a temperature of about 25° to 80° C. and at a pressure of about 1 atm to 10 atm.

4. The method of claim 3, wherein the electric potential is constant.

5. The method of claim 1, wherein the solvent added to the anode compartment is a polar solvent.

6. The method of claim 1, wherein the proportion of the iodoaryl compound to the aryl compound to the first organic salt and to the solvent is about 0.8:1:1:1 to 1.2:1:10:10 by weight.

7. The method of claim 1, wherein the iodoaryl compound is selected from the group consisting of iodobenzene, iodotoluene, iodonaphthalene, iodopyridine, iodothiophene, and iodopyrrole.

8. The method of claim 1, wherein the proportion of the hydroxyalkyl compound to the second organic salt is about 1:1 to 1:10.

9. The method of claim 1, wherein the first and second organic salts are selected from the group consisting of alkali and tetraalkylammonium salts of acetic acid, trihaloacetic acid, p-toluene sulfonic acid, benzenesulfonic acid, IH, BrH, and $F_4BH$.

10. The method of claim 1, wherein the first and second organic salts are the same.

11. The method of claim 1, wherein the aryl compound is selected from the group consisting of benzene, toluene, naphthalene, thiophene, and pyrrole.

12. The method of claim 1, wherein the hydroxyalkyl compound is selected from the group consisting of $(C_1-C_{12})$aliphatic alcohols and $(C_6-C_{20})$araliphatic alcohols.

13. A method of preparing an alkyl ester of an aryl acid, comprising adding to the anode compartment of an electrolytic cell comprised of an anode a first electrolytic solution comprising an aryl compound, an iodoaryl compound, a solvent and a first organic salt; adding to the cathode compartment of the cell comprised of a cathode a second electrolytic solution comprising a hydroxyalkyl compound and a second organic salt; applying to the anode and the cathode an electric potential, said potential and the proportion of said compounds and said salts being effective to form a diaryliodonium salt in the anode compartment and an alkoxide salt in the cathode compartment; and admixing the diaryliodonium salt and the alkoxide salt in the presence of carbon monoxide, the salts and the carbon monoxide being present in a proportion and under conditions effective to obtain an alkyl ester of an aryl acid.

14. The method of claim 13, wherein the iodoaryl compound and the aryl compound added to the anode compartment are iodotoluene and toluene; the hydroxyalkyl compound added to the cathode compartment is methanol; and the alkyl ester of an aryl acid obtained is the methyl ester of toluenebenzoic acid.

15. The method of claim 13, wherein the diaryliodonium salt and the alkoxide salt are admixed with the carbon monoxide in the presence of a catalyst.

16. The method of claim 13, further comprising removing the solvent from the diaryliodonium salt prior to admixing the diarylodonium salt and the alkoxide salt with the carbon monoxide.

17. The method of claim 13, wherein the proportion of the diaryliodonium salt to the alkoxide salt to the carbon monoxide is about 0.8:1:5 to 1.2:2:10 by weight.

18. The method of claim 13, wherein the diaryliodonium salt and the alkoxide salt are admixed with the carbon monoxide at a temperature of about 5° to 150° C. and a pressure of about 1 atm and 5 atm for a period of time of about 0.5 hours to 24 hours.

* * * * *